United States Patent [19]

Catsburg

[11] 4,274,827

[45] Jun. 23, 1981

[54] PROPULSION SYSTEM FOR A MARINE VESSEL

[75] Inventor: Wilhelmus M. Catsburg, Capelle A/D Ijssel, Netherlands

[73] Assignee: Schottel Nederland B.V., Netherlands

[21] Appl. No.: 942,624

[22] Filed: Sep. 15, 1978

[30] Foreign Application Priority Data

Sep. 19, 1977 [NL] Netherlands ..... 7710276

[51] Int. Cl.[3] ..... B63H 5/12

[52] U.S. Cl. ..... 440/54; 64/23; 192/67 R; 308/140

[58] Field of Search ..... 115/41 R, 35; 64/23; 416/170; 192/67 R; 308/140; 440/54

[56] References Cited

U.S. PATENT DOCUMENTS 2,451,683 10/1948 Mantle ..... 308/140 X

FOREIGN PATENT DOCUMENTS 1272050 7/1968 Fed. Rep. of Germany ..... 64/23

2229608 12/1974 France ..... 115/41 R 991704 5/1965 United Kingdom ..... 115/41 R

*Primary Examiner*—Sherman D. Basinger

*Attorney, Agent, or Firm*—Ostrolenk, Faber, Gerb & Soffen

[57] ABSTRACT

A propulsion system including a steerable propeller which can be vertically lowered out of and raised into a vertical protecting sleeve is disclosed. The propeller is driven from a motor lying above deck of a ship driven by the propeller and a shaft connects the propeller with the motor. The drive shaft includes an upper part which fits in a telescopic manner into a lower hollow shaft connected to vertical displacement apparatus.

1 Claim, 3 Drawing Figures

PROPULSION SYSTEM FOR A MARINE VESSEL

BACKGROUND OF THE INVENTION

The present invention is directed to a propulsion system for a marine vessel comprising a steerable propeller including an under water housing enclosing drive gears and connected to a ship's propeller. The housing is fixed to the lower end of a steering tube which is coupled to a swivel drive at its upper end, the driving shaft for the propeller being accommodated therein. The steerable propeller further includes a sleeve for enclosing the under water housing, propeller, steering tube, swivel-drive and driving shaft, means for guiding the propeller and under water housing within the sleeve, for lowering the assembly below said sleeve and for subsequently raising same, the steerable propeller being provided with a motor near the upper part of the sleeve, the shaft of said motor being coupled with the driving shaft of the propeller.

Similar, steerable propellers are known in different variants and are mounted in a vessel or other floating craft, either for steering them or for retaining them at a defined position (so called dynamic positioning). In certain circumstances, such as when the vessel is sailed in shallow areas or when entering a port, the under water housing with the propeller is raised within the sleeve, thereby preventing the protrusion of vulnerable parts from the bottom of said sleeve. This raising of the under water housing and its successive lowering is a drastic undertaking, whereby not only very large masses have to be displaced, but whereby also parts of the steerable propeller may protrude above the deck of the vessel, particularly the driving shaft and the motor coupled therewith (driving set), which participate in the vertical movement of the assembly.

SUMMARY OF THE INVENTION

The primary object of the invention is to improve the prior art steering propeller and to provide an apparatus by means of which the under water housing and the propeller can be raised and subsequently lowered without heavy parts of the apparatus being lifted above the deck of the vessel. This aim is achieved according to the invention, by forming the driving shaft of an initial part, directed upwards from the swivel-drive, and a hollow second part connected with the initial part and directed downwards, whereby the initial part of the shaft fits with some play telescopically in the second hollow part of the shaft, that can be moved up and down. Thus the (heavy) motor for the driving of the propeller can, for example, either be fixed permanently on deck the vessel or under the cover (cap) of the sleeve, while the lower portion of the steerable propeller can still be retracted. A further extremely important advantage of the present invention consists in that the upper end of the driving shaft can be connected to a gear case which makes it possible to use a diesel-engine with a horizontal shaft to drive the propeller. The conventional apparatus did not allow for such an arrangement, owing to the extremely difficult movability of such an engine.

The first portion of the shaft of the steerable propeller in accordance with the invention is a shaft, suspending from the motor shaft by means of a footstep bearing at both ends being connected with a ring, forming part of a self-adjusting rotary coupling with the motor shaft and with the hollow second part of the shaft. The self-adjustability of the rotary couplings only need to take up an angular inclination of a few degrees, as there are no considerable deviations. During the mounting of the assembly reasonable tolerances are allowed for possible deviations. As a result of the very stable construction, obtained by the application of a hollow sleeve, this alignment is maintained during operation of the assembly. The self-adjustability mentioned is substantially intended for receiving any deformation, derived from the large powers, that may arise during maneuvering with the steerable propeller at full speed.

The provision according to the invention may be used both for a steerable propellers, having fixed blades, and for a propeller having adjustable blades. The invention offers the advantage, that considerable less mass has to be displaced during raising and lowering of the under water housing.

In an alternative embodiment the connection between the lower end of the first part of the shaft and the inner ring of the self-adjusting rotary coupling is formed by two gears, exactly fitting into each other. The first part of the shaft is provided along at least two generating lines with a slit, in which a spigot is engaged being secured to the inner ring. The whole driving couple is transmitted by the said gears. The applied spigot guide warrants the gears to slide into each other unhindered during the successive lowering of the under water housing.

SURVEY OF THE DRAWINGS

FIG. 1 is a partial cross sectional elevational view of the whole steerable propeller, in its active position, while the retracted position of the lower part is illustrated in thin lines.

DESCRIPTION OF A PREFERRED EMBODIMENT

Figure 2:
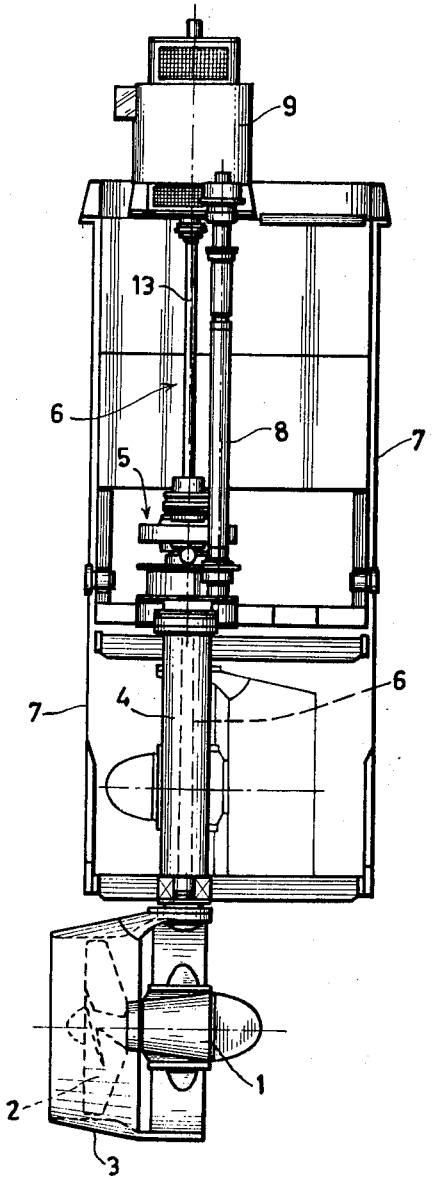
FIG. 2 is an axial section on an enlarged scale of the two ends of the initial part of the drive shaft.

The sterrable propeller consists of an under water housing 1 connected to a ship's propeller 2. The propeller is encircled by the usual stream funnel 3. The housing 1 is fixed at the lower end of the steering tube 4, that has a swivel-drive at its upper end for the under water housing 1. Within the tube 4 the driving shaft 6 for the propeller 2 is accomodated. The assembly further includes a sleeve 7 for enclosing the under water housing 1, the propeller 2, the steering tube 4, the swivel-drive 5 and the driving shaft 6. Within said sleeve 7 means 8 are present (for example screw spindles) for lowering the propeller 2 with the under water housing 1 under the sleeve and subsequently raising same. The steerable propeller is provided with a motor 9 near the upper end of the sleeve 7. The shaft 10 of motor 9 is coupled to the driving shaft 6 of propeller 2. Motor 9 forms, together with auxiliary devices (not shown), the driving set for the propeller 2.

The driving shaft 6 consists of an initial part 11 of the shaft 6 (FIG. 2), directed upwards from the swivel-drive 5, and a hollow second part 12 of the shaft 6 connected herewith, and directed downwards. As can be seen in FIG. 2, this initial part 11 of the shaft is a massive shaft 13, being suspended from the motor shaft 10 by means of a footstep bearing. The massive shaft 13 fits with some play telescopically in the hollow part 12 of the shaft, that can be moved up and down.

A respective ring 15, 16 is located at either end of massive shaft 13 and forms part of a self-adjusting rotary coupling 17. The upper coupling 15,17 forms the connection with the motor shaft 10, while the lower rotary coupling 16,17 forms the connection with the hollow second part of the shaft 12.

Figure 3:
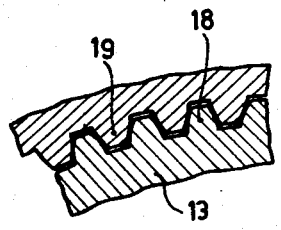
FIG. 3 is an enlarged detail cross section along the line III—III in FIG. 2.
Figure 2:
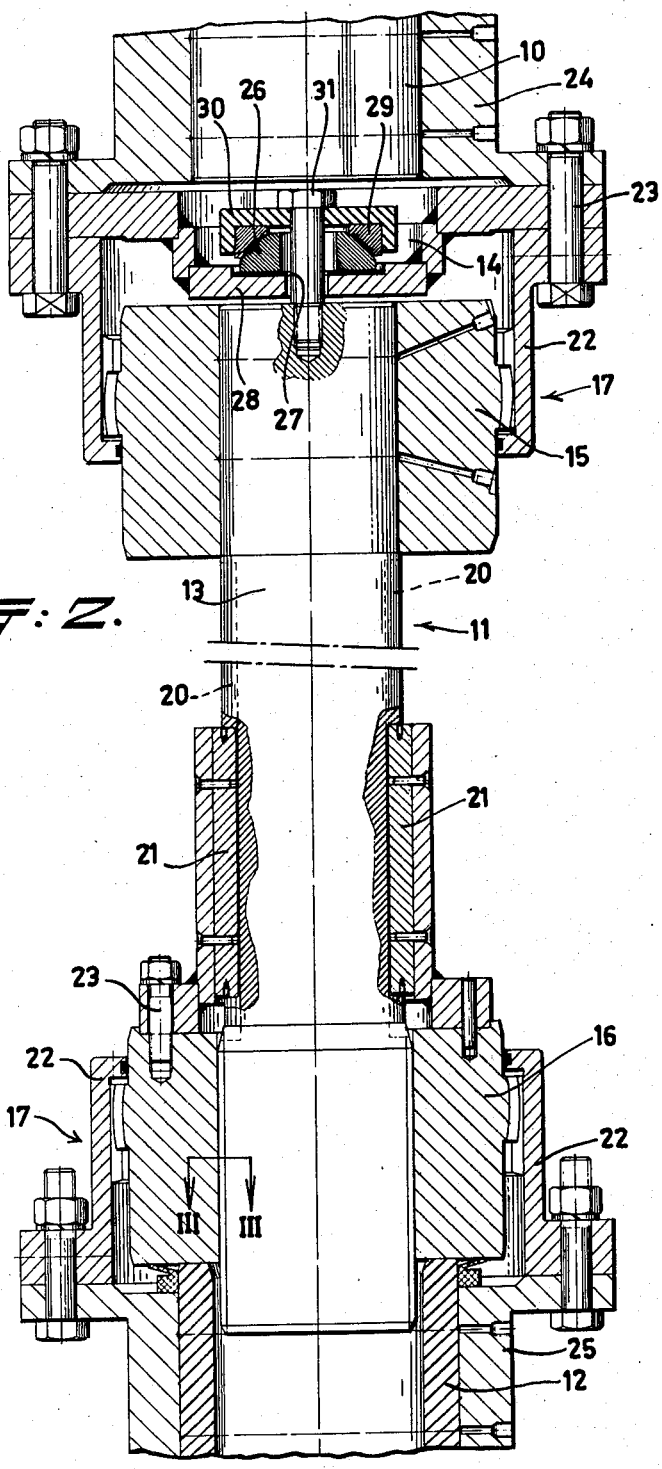

The connection between the lower end of the shaft 13 and the inner ring 16 of the self-adjusting rotary coupling 17 is formed by two gears 18,19 (see FIG. 3) whose teeth fit into each other exactly. Further shaft 13 is provided with a pair of axial grooves 20, each of which receives a respective spigot 21, which is fixedly connected to the inner ring 16. The assembly consisting of the spigots 21 and the ring 16 bears on the upper end of the hollow second part of the shaft 12. FIG. 2 illustrates the active position of the propeller 2, whereby the under water housing 1 is lowered below the sleeve 7 while the shaft 13 is coupled, via the gears 18,19, with the part 12 of the shaft. The couplings 17 each comprise an outer ring 22, fixedly connected with a respective socket 24, 25, by bolts 23. The upper socket 24 is shrunk upon the motor shaft 10, while the lower socket 25 is shrunk upon the hollow part 12 of the shaft.

During a subsequent raising of the under water housing 1 with the propeller 2 to within the sleeve 7, the following elements (represented in FIG. 2) move upwards:

the second part 12 of the shaft;

the socket 25;

the lower rotary coupling 17 with the inner ring 16 and the outer ring 22;

the spigots 21.

During the upwardly directed movement, the gear 18 is detached from the gear 19 while part 12 of the shaft slides gradually along the shaft 13. The presence of the spigots 21, which move through the grooves 20, will during a successive lowering of the under water housing 1 with the propeller 2 outside the bottom of the sleeve 7, cause an unhampered and precisely aligned sliding of the gear 18 into meshing engagement with gear 19.

The footstep bearing 14 is built up of a lower ring 26 having a convexly curved upper surface, said ring 26 bearing through a resilient intermediate layer 27, on a composite intermediate element 28, suspending from the mother shaft 10, via bolts 23 and the socket 24. The lower ring 26 interacts with an upper ring 29 having a concave lower surface adapted to the convex shape of the upper surface of the ring 26. Upon the ring 29 a cap 30 is positioned, from which the shaft 13 is suspended via a bolt 31. Deformations which might occur in shaft 13 during operation of the propeller will be extremely small and can be easily absorbed by the couplings 17 and the footstep bearing 14.

The most important advantage of the steerable propeller according to the present invention lies in the telescoping of the two parts 11 and 12 of the shaft, by means of which the under water housing 1 with the ship's propeller can be retracted, thereby avoiding an upward and downward movement of the driving set (the motor 9).

What is claimed is:

1. A propulsion system for a marine vessel, comprising:

(A) a vertical sleeve;

(B) a drive motor located near the upper end of said sleeve and including a vertically extending output shaft;

(C) a steerable propeller comprising:

(1) a steering tube coupled to said sleeve for rotation about a vertical axis;

(2) swivel drive means coupled to the top of said steering tube for rotating said steering tube about said vertical axis;

(3) a telescopable drive shaft extending through said steering tube and including an upper portion and a lower portion, said upper portion being coupled to said output shaft of said motor by a footstep bearing including complementary concave and convex bearing parts, said concave bearing part being coupled to said upper portion of said drive shaft, said convex bearing part being coupled to said output shaft of said motor;

(4) said upper portion of said drive shaft being solid and said lower portion of said drive shaft being hollow and telescopically receiving said solid upper portion, said upper and lower portions being coupled for rotation with one another by a self-adjusting rotary coupling, said rotary coupling including inner and outer concentric rings;

(5) an underwater housing coupled to the bottom of said steering tube for rotation therewith, said underwater housing enclosing drive gears coupling a ship's propeller to said drive shaft; and (D) means for raising and lowering an assembly including said steering tube, said lower portion of said drive shaft, said underwater housing and said swivel drive means between an upper position wherein said assembly is fully withdrawn into said sleeve and a lower position wherein said propeller extends below said sleeve; and (E) said inner concentric ring having teeth which interlock with corresponding teeth on said upper portion of said drive shaft when said assembly is in said lower position, said inner ring also having a pair of spigots attached thereto, said spigots engaging respective grooves in said upper portion of said drive shaft such that the orientation of said upper and lower portions of said drive shaft remain constant as said lower portion of said drive shaft moves from said upper to said lower position to reengage said interlocking teeth.

* * * * *